US007013581B2

(12) United States Patent
Greene et al.

(10) Patent No.: US 7,013,581 B2
(45) Date of Patent: Mar. 21, 2006

(54) ARTICLE OF FOOTWEAR HAVING A SUSPENDED FOOTBED

(75) Inventors: Pamela Susan Greene, Portland, OR (US); David Patrick Jones, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/460,737

(22) Filed: Jun. 11, 2003

(65) Prior Publication Data

US 2004/0250446 A1 Dec. 16, 2004

(51) Int. Cl.
*A43B 13/00* (2006.01)

(52) U.S. Cl. ..... 36/25 R; 36/31; 36/88; 36/114

(58) Field of Classification Search ..... 36/28, 36/25 R, 30 R, 30 A, 31, 3 R, 3 B, 88, 107, 36/114

See application file for complete search history.

(56) References Cited

U.S. PATENT DOCUMENTS

| | | | | |
|---|---|---|---|---|
| 4,071,963 | A * | 2/1978 | Fukuoka | 36/3 B |
| 4,078,321 | A * | 3/1978 | Famolare, Jr. | 36/3 B |
| 4,506,460 | A * | 3/1985 | Rudy | 36/28 |
| 4,547,978 | A * | 10/1985 | Radford | 36/3 B |
| 4,561,195 | A | 12/1985 | Onoda et al. | |
| 4,608,768 | A | 9/1986 | Cavanagh | |
| 4,747,219 | A * | 5/1988 | Ammendolea | 36/28 |
| 4,878,300 | A | 11/1989 | Bogaty | |
| 4,878,301 | A | 11/1989 | Kiyosawa | |
| 4,939,851 | A * | 7/1990 | Miller | 36/3 B |
| 5,042,174 | A * | 8/1991 | Nichols | 36/25 R |
| 5,070,629 | A | 12/1991 | Graham et al. | |
| 5,337,492 | A * | 8/1994 | Anderie et al. | 36/28 |
| 5,390,430 | A * | 2/1995 | Fitchmun et al. | 36/30 R |
| 5,402,588 | A | 4/1995 | Graham et al. | |
| 5,561,920 | A | 10/1996 | Graham et al. | |
| 5,595,002 | A | 1/1997 | Slepian et al. | |
| 5,595,003 | A * | 1/1997 | Snow | 36/28 |
| 5,651,196 | A * | 7/1997 | Hsieh | 36/27 |
| 5,680,714 | A * | 10/1997 | Lopez | 36/27 |
| 5,720,118 | A * | 2/1998 | Mayer et al. | 36/107 |
| 5,729,917 | A | 3/1998 | Slepian et al. | |

(Continued)

FOREIGN PATENT DOCUMENTS

| | | |
|---|---|---|
| DE | 8811889 | 11/1988 |

(Continued)

OTHER PUBLICATIONS

International Search Report mailed Sep. 29, 2004 in corresponding PCT case, international application No. PCT/US2004/015588.

*Primary Examiner*—Marie Patterson
(74) *Attorney, Agent, or Firm*—Banner & Witcoff, Ltd.

(57) ABSTRACT

An article of footwear is disclosed that includes an upper and a sole structure secured to the upper. The sole structure has a concave element, a footbed, and a core. The concave element has a structure that includes a base portion and sidewalls extending upward from the base portion to define a cavity within the concave element. The footbed is secured to the sidewalls and suspended above at least a portion of the cavity. The footbed includes a plurality of beams that extend across the cavity. The beams are separated by spaces in the footbed, and the beams may be oriented parallel to each other. In this configuration, at least a portion of the beams are independently deflectable into the cavity. The core is positioned within the cavity and below the footbed, and the core may be formed of a compressible material.

62 Claims, 8 Drawing Sheets

U.S. PATENT DOCUMENTS

| | | | | |
|---|---|---|---|---|
| 5,815,949 | A | 10/1998 | Sessa | |
| 5,860,226 | A | 1/1999 | Graham et al. | |
| 6,131,310 | A * | 10/2000 | Fang | 36/28 |
| 6,192,607 | B1 | 2/2001 | Kolada et al. | |
| 6,305,100 | B1 * | 10/2001 | Komarnycky et al. | 36/3 R |
| 6,321,469 | B1 * | 11/2001 | Cretinon | 36/102 |
| 6,408,544 | B1 * | 6/2002 | Hernandez | 36/103 |
| 6,601,321 | B1 * | 8/2003 | Kendall | 36/88 |
| 6,754,982 | B1 * | 6/2004 | Reed et al. | 36/30 A |
| 2002/0017036 | A1 | 2/2002 | Berger et al. | |

FOREIGN PATENT DOCUMENTS

| | | |
|---|---|---|
| EP | 0 382 904 | 8/1990 |
| EP | 0 677 253 | 10/1995 |
| GB | 408937 | 4/1934 |

* cited by examiner

ARTICLE OF FOOTWEAR HAVING A SUSPENDED FOOTBED

BACKGROUND OF THE INVENTION

1. Field of the Invention

The present invention relates to the field of footwear. The invention concerns, more particularly, a sole structure for an article of footwear having a suspended footbed with a slatted structure that includes a plurality of beams for supporting a foot. The invention has application to a variety of footwear styles, including athletic footwear utilized for walking, running, or a plurality of other athletic activities.

2. Description of Background Art

Conventional articles of athletic footwear include two primary elements, an upper and a sole structure. The upper is often formed of leather, synthetic materials, or a combination thereof and comfortably secures the footwear to the foot, while providing ventilation and protection from the elements. The sole structure generally incorporates multiple layers that are conventionally referred to as an insole, a midsole, and an outsole. The insole is a thin, cushioning member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling potentially harmful foot motions, such as over pronation, attenuating ground reaction forces, and absorbing energy. In order to achieve these purposes, the midsole may have a variety of configurations, as discussed in greater detail below. The outsole forms the ground-contacting element of footwear and is usually fashioned from a durable, wear-resistant material that includes texturing to improve traction.

The primary element of a conventional midsole is a resilient, polymer foam material, such as polyurethane or ethylvinylacetate, that extends throughout the length of the footwear. The properties of the polymer foam material in the midsole are dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

In addition to polymer foam materials, conventional midsoles may include, for example, stability devices that resist over-pronation and moderators that distribute ground reaction forces. The use of polymer foam materials in athletic footwear midsoles, while providing protection against ground reaction forces, may introduce instability that contributes to a tendency for over-pronation. Pronation is the inward roll of the foot while in contact with the ground. Although pronation is normal, it may be a potential source of foot and leg injury, particularly if it is excessive. Stability devices are often incorporated into the polymer foam material of the midsoles to control the degree of pronation in the foot. Examples of stability devices are found in U.S. Pat. No. 4,255,877 to Bowerman; U.S. Pat. No. 4,287,675 to Norton et al.; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al. In addition to stability devices, conventional midsoles may include fluid-filled bladders, as disclosed in U.S. Pat. Nos. 4,183,156 and 4,219,945 to Marion F. Rudy, for example.

Despite the variations in midsole configurations and the various stability devices and fluid-filled bladders, conventional midsoles are primarily formed of a unitary element of polymer foam material. Polymer foam materials are often impermeable to air and liquids and are, therefore, relatively difficult to ventilate. In addition, polymer foam materials that provide a suitable degree of stability, ground reaction force attenuation, and energy absorption may be relatively inflexible and heavy. When midsoles are formed of lightweight polymer foams to increase flexibility and reduce weight, the polymer foam is susceptible to compression set. That is, the individuals cells within the polymer foam material may break down following repeated compressions. Furthermore, lightweight polymer foam materials may exhibit reduced stability in comparison with heavier, more dense polymer foam materials.

SUMMARY OF THE INVENTION

The present invention is an article of footwear having an upper and a sole structure. The upper defines a void for receiving a foot, and the sole structure is secured to the upper. The sole structure defines a cavity and has a footbed suspended between at least a portion of the cavity and the void to provide support for the foot. The footbed includes a plurality of beams that extend across the cavity, at least a portion of the beams being independently deflectable into the cavity.

The beams may have a configuration that extends from a medial side of the footwear to a lateral side of the footwear, and a plurality of spaces may be formed between at least a portion of the beams. The footbed may include a perimeter portion that extends around the footbed and forms a perimeter of the footbed, with the beams extending between opposite sides of the perimeter portion. Furthermore, a portion of the beams may be joined together with a link structure.

The cavity and the footbed may extend from a forefoot portion of the sole structure to a heel portion of the sole structure. The cavity may be formed in a support element having a base portion and sidewalls extending upward from the base portion. Alternately, the support element may only have sidewalls. In order to provide an attachment for the footbed, the footbed may be secured to the upper surface of the sidewalls, or the sidewalls may define an indentation that receives the perimeter portion of the footbed. A plate may also be positioned within the cavity and adjacent to the base portion, and a portion of the plate may extend upward and along the sidewalls.

A core may be located within the cavity, and may be spaced from the footbed. In general, the core may extend from a medial side of the cavity to a lateral side of the cavity, and the core may be formed of a compressible material, such as a polymer foam material. In order to enhance ventilation of the footwear, at least one aperture may extend through the core and through the base portion of the sole structure, thereby permitting air and water to pass through the cavity. A variety of filter materials may be utilized to permit the passage of air, but prevent particulates from entering the sole structure. The position of the filter materials may vary so as to be positioned between the core and the base portion or between the core and the footbed.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose various articles of footwear in accordance with the present invention. An article of footwear 10 is initially depicted and has the configuration of a walking shoe. Various concepts related to the structure of footwear 10 may be applied to a plurality of other styles of athletic footwear, including basketball shoes, tennis shoes, running shoes, and cross-training shoes, for example. The general structure of footwear 10 may also be applied to specialized forms of footwear that include ice skates, in-line skates, ski boots, and snowboarding boots. In addition, the concepts disclosed with respect to footwear 10 may be applied to non-athletic footwear, such as dress shoes, boots, and sandals. The present invention, therefore, applies to a wide variety of footwear styles and is not limited to the precise embodiments or footwear styles specifically disclosed herein.

Figure 1:
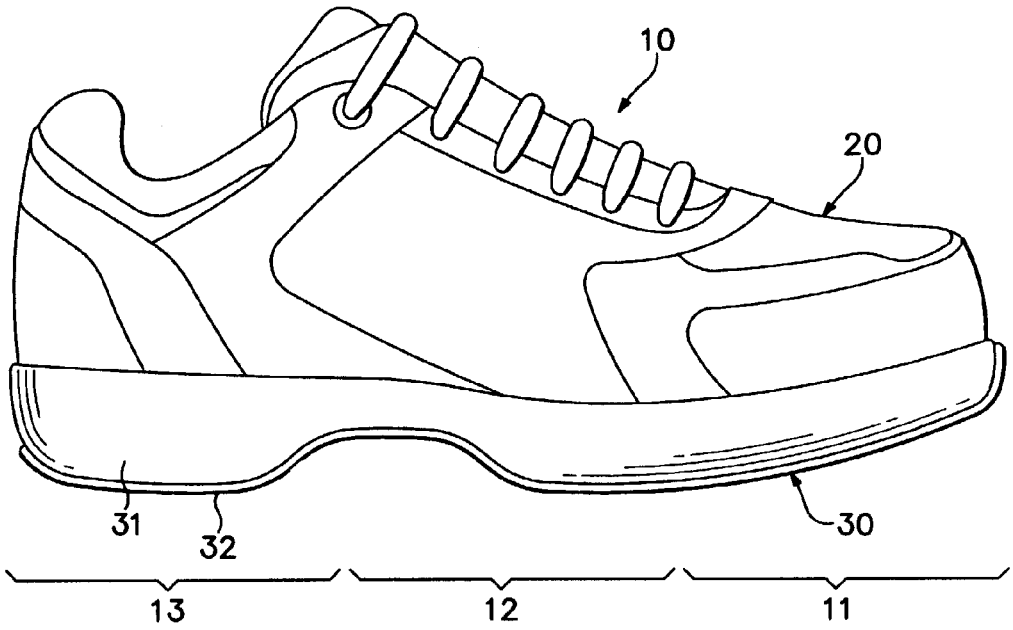
FIG. 1 is a lateral side elevational view of an article of footwear incorporating a sole structure in accordance with the present invention.

Footwear 10 is depicted in FIGS. 1–4 and includes an upper 20 and a sole structure 30. Upper 20 is secured to sole structure 30 and forms an interior void that comfortably receives a foot and secures the position of the foot relative to sole structure 30. One skilled in the relevant art will recognize that upper 20 may have a generally conventional configuration and will not, therefore, be discussed in significant detail. The configuration of upper 20, as depicted in FIG. 1, is suitable for use during athletic activities that involve walking. Accordingly, upper 20 may have a lightweight, breathable construction that includes multiple layers of leather, textile, polymer, and foam elements adhesively bonded and stitched together. For example, upper 20 may have an exterior that includes leather elements and textile elements for resisting abrasion and providing breathability, respectively. The interior of upper 20 may incorporate foam elements for enhancing the comfort of footwear 10, and the interior surface may include a moisture-wicking textile for removing excess moisture from the area immediately surrounding the foot.

For purposes of reference, footwear 10 may be divided into three general regions: a forefoot region 11, a midfoot region 12, and a heel region 13, as defined in FIG. 1. Regions 11–13 are not intended to demarcate precise areas of footwear 10. Rather, regions 11–13 are intended to represent general areas of footwear 10 that provide a frame of reference during the following discussion. In addition, footwear 10 includes a medial side 14 and a lateral side 15. Although regions 11–13 and sides 14–15 apply generally to footwear 10, references to regions 11–13 and sides 14–15 may also apply specifically to upper 20, sole structure 30, or a particular component of either upper 20 or sole structure 30.

In manufacturing footwear 10, the various elements of upper 20 are assembled around a last that imparts the general shape of a foot to the void within upper 20. That is, the various elements are assembled around the last to form medial side 14 and lateral side 15 of upper 20, which extend from forefoot region 11 to heel region 13. In addition, an instep portion that includes a throat, tongue, and laces are formed, for example, and an ankle opening is formed in heel region 13 to provide the foot with access to the void within upper 20. Sole structure 30 is then permanently secured to a lower portion of upper 20 with an adhesive, for example. Alternately, upper 20 and sole structure 30 may be secured through stitching, welding, or through a combination of adhesives, stitching, and/or welding. An insole (not depicted) may then be positioned within upper 20 and adjacent to sole structure 30 to substantially complete the manufacture of footwear 10. In this manner, footwear 10 is manufactured through a substantially conventional process.

Despite the substantially conventional process for manufacturing footwear 10, sole structure 30 has a configuration that differs significantly from a conventional sole structure for athletic footwear. In contrast with the conventional sole structure, which includes the conventional foam midsole, sole structure 30 has a slatted footbed suspended over a cavity. That is, sole structure 30 has a footbed with a plurality of beams extending over the cavity. This general configuration for sole structure 30 may enhance the flexibility of footwear 10 and the distribution of plantar forces, thereby imparting comfort to footwear 10. Furthermore, this general configuration for sole structure 30 may isolate the foot from discontinuities on the ground (e.g., rocks, bumps, branches, etc.), and sole structure 30 may be effectively ventilated. The advantages of sole structure 30 described above and specifics regarding the configuration of sole structure 30 will be discussed in greater detail in the following material.

Figure 3A:
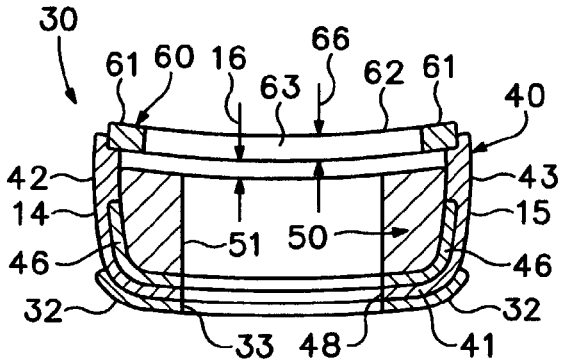
FIG. 3A is a first cross-sectional view of the sole structure, as defined by section line 3A—3A in FIG. 2.
Figure 2:
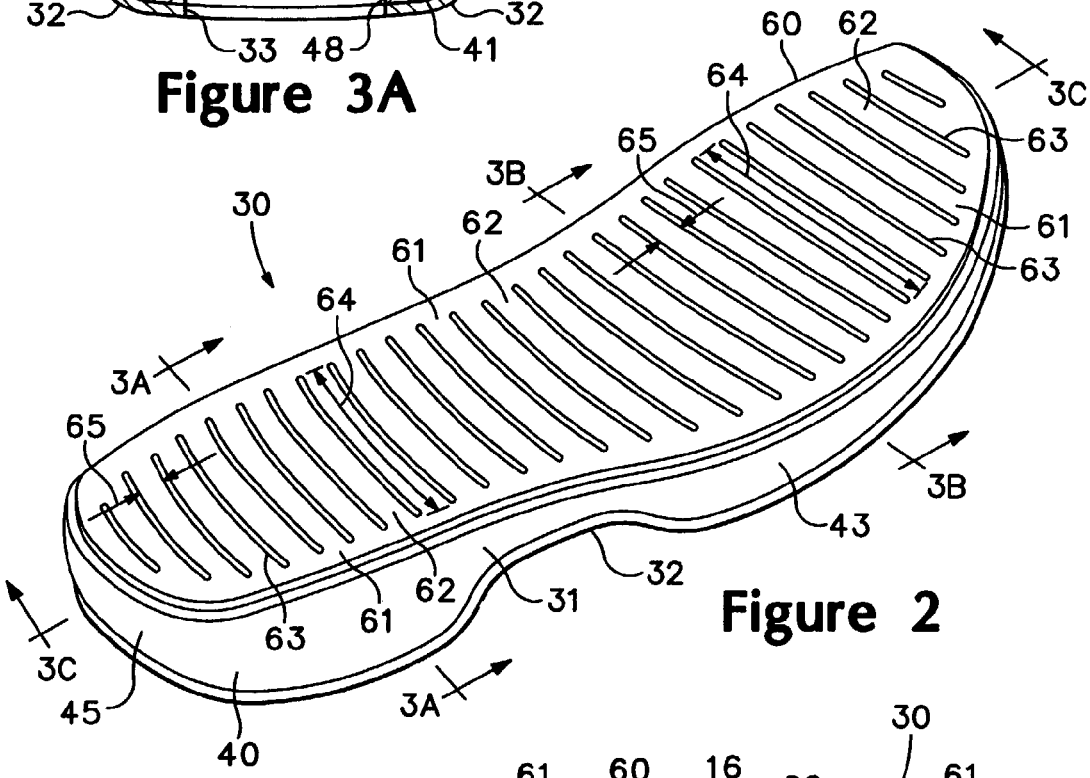
FIG. 2 is a perspective view of the sole structure.
Figure 3B:
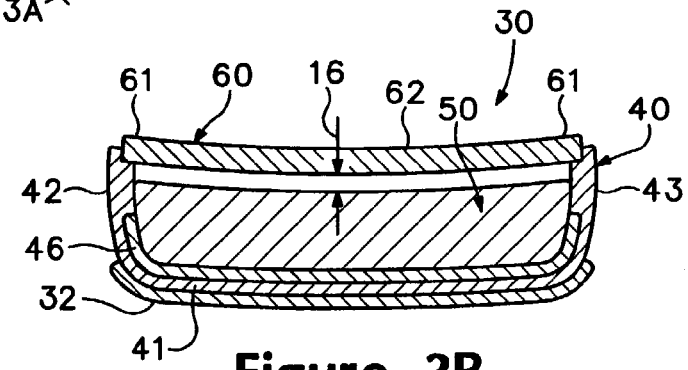
FIG. 3B is a second cross-sectional view of the sole structure, as defined by section line 3B—3B in FIG. 2.
Figure 3C:
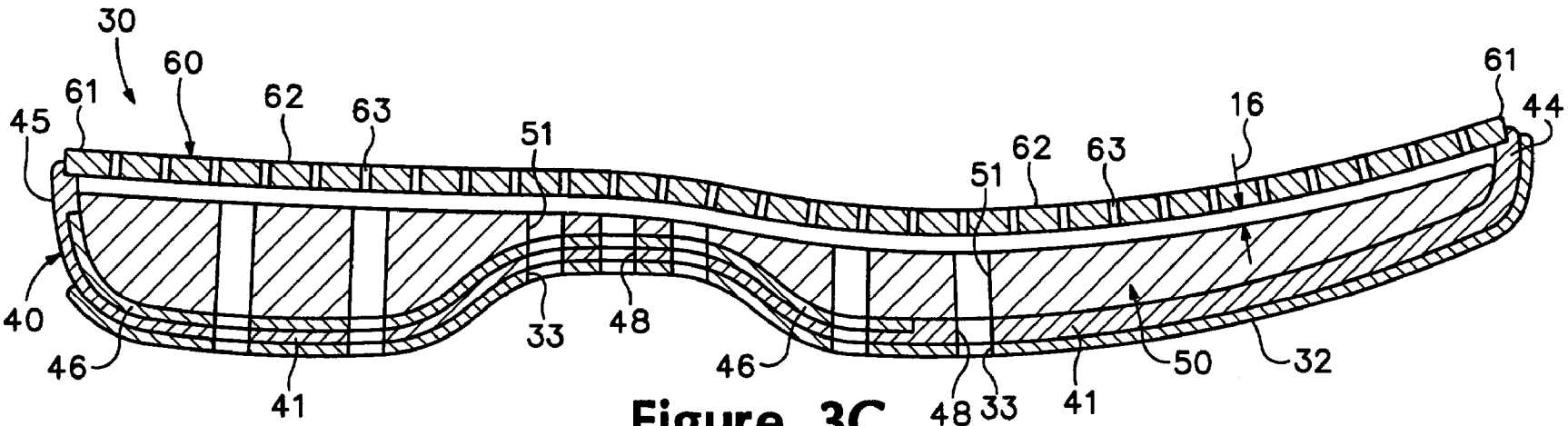
FIG. 3C is a third cross-sectional view of the sole structure, as defined by section line 3C—3C in FIG. 2.
Figure 4:
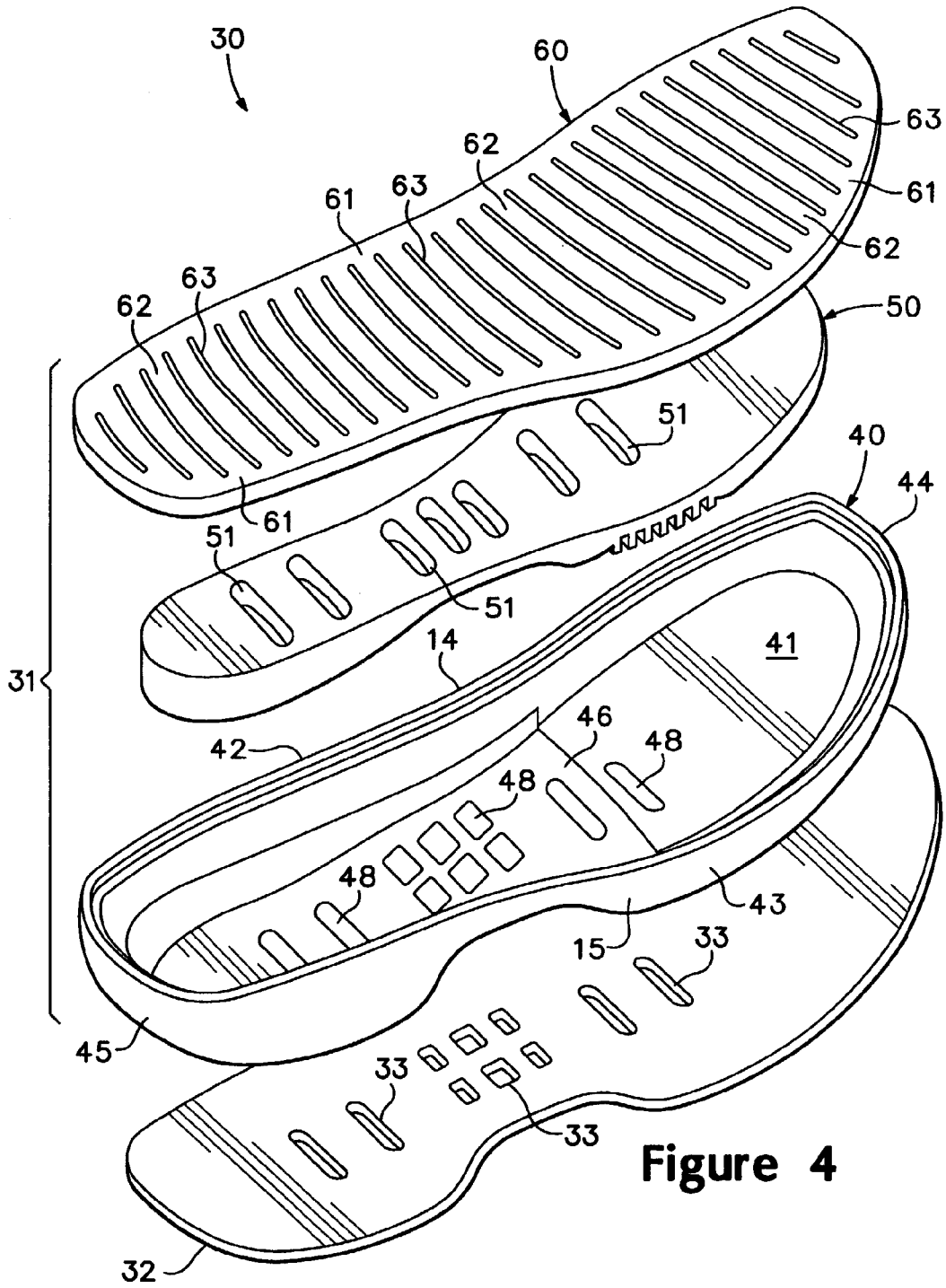
FIG. 4 is an exploded perspective view of the sole structure.

Sole structure 30 is depicted individually in FIGS. 2–4 and includes a midsole 31 and an outsole 32 that is secured to a lower surface of midsole 31. The primary components of midsole 31 are a concave support element 40, a core 50, and a footbed 60. In general, core 50 is positioned within support element 40, and footbed 60 is suspended above core 50. In use, the foot rests upon footbed 60 and the weight of the individual is transferred from footbed 60 to the ground through support element 40 and outsole 32. During running, walking, or other activities, footbed 60 may deflect such that a portion of footbed 60 contacts and compress corresponding areas of core 50.

Support element 40 forms a cavity that receives core 50 and facilitates the downward deflection of footbed 60 as the individual walks or runs, for example. Support element 40 exhibits, therefore, a generally concave structure that is formed by a base portion 41, a medial sidewall 42, a lateral sidewall 43, a forefoot wall 44 and a heel wall 45. Base portion 41 may be formed integral with walls 42–45 in order to enhance the durability of support element 40, and base portion 40 may extend throughout the area from forefoot region 11 to heel region 13 and from medial side 14 to lateral side 15. The lower surface of base portion 41 is secured to outsole 32, and the upper surface of base portion 41 may be secured to core 50. Alternately, core 50 may rest upon the upper surface of base portion 41. Walls 42–45 extend upward from base portion 41 and extend continuously around base portion 41 to impart the concave structure. In some embodiments of the present invention, walls 42–45 may include gaps or apertures that impart a segmented or discontinuous configuration to support element 40.

The material selected for support element 40 should be sufficient to support the weight of the individual, and may be compressible under the weight of the individual so as to impart ground reaction force attenuation and energy absorption. That is, the material selected for support element 40 may impart a portion of the cushioning provided by sole structure 30. In addition, the material of support element 40 may be selected to resist microbe growth and have oleophobic and hydrophobic properties. Accordingly, suitable materials for support element 40 include a variety of polymer foam materials, such as polyurethane, polyether, ethylvinylacetate, or a blend of ethylvinylacetate and rubber. One suitable hardness range for the material forming support element 40 is 55–75 on the Asker C scale.

The material forming support element 40 may also have different densities in different areas of support element 40. For example, the polymer foam material forming heel region 13 may have a greater density than the polymer foam material forming forefoot region 11 and midfoot region 12. In addition, the polymer foam material forming lateral side 15 may have lesser density than the polymer foam material forming medial side 14 in order to resist pronation, which is the inward roll of the foot as the foot is in contact with the ground. As a further example, the polymer foam material forming walls 42–45 may have a greater density than the polymer foam material forming base portion 41 in order to impart greater strength and compression resistance in portions that provide support. Alternately, support element 40 may have differential density from an upper area to a lower area. For example, therefore, the upper area of support element 40 may exhibit a relatively dense structure and the lower area of support element 40 may exhibit a less dense structure.

A stabilizer plate 46 is depicted in FIG. 4 as extending along the upper surface of base portion 41 in midfoot region 12 and heel region 13, and stabilizer plate 46 extends upward along portions of medial sidewall 42, lateral sidewall 43, and heel wall 45. Stabilizer plate 46 may be utilized to moderate compressive loads in heel region 13 or to transfer compressive loads to a greater area of support element 40. Suitable materials for stabilizer plate 46 include diecut, molded, or thermoformed polymers having a hardness above 65, for example, on the Asker C scale. In addition, the material forming stabilizer plate 46 may be a polymer foam material, such as polyurethane or ethylvinylacetate. In some embodiments of the present invention, the stabilizer plate may be absent.

Stabilizer plate 46 is depicted in FIG. 4 as being positioned adjacent the interior surface of support element 40, but may also be embedded within support element 40 or may be positioned on the exterior of support element 40. Stabilizer plate 46 may also extend along the entire surface of base portion 41, may be located solely within midfoot region 12, may be formed of a plurality of separate plates, or stabilizer plate 46 may be absent from sole structure 30. Furthermore, stabilizer plate 46 may be molded into support element 40, and may be a polymer foam material having a greater density than other portions of support element 40. One skilled in the relevant art will recognize, therefore, that stabilizer plate 46 may have a variety of configurations within the scope of the present invention.

The above discussion discloses support element 40 and outsole 32 as being separate elements. In an alternate configuration of the invention, support element 40 may be formed from the same material as outsole 32. Accordingly, sole structure 30 may include footbed 60 and a single concave support element 40 that contacts the ground and forms the sidewalls. In some embodiments, base portion 41 may be absent, and base portion 41 may be replaced with outsole 32.

Core 50 is securely positioned within support element 40 and extends along base portion 41 and along portions of walls 42–45. As depicted in FIGS. 3A–3C, core 50 is spaced below footbed 60 by a displacement distance 16, which is represented by a double-headed arrow. A variety of materials may be utilized for core 50, including low-density polyether polyurethane having a specific gravity of 0.35 or less, a soft-durometer ethylvinylacetate, a fluid-filled bladder, fibrous matted materials, or a spacer mesh, for example. Suitable materials for core 50 may be lightweight so as to limit the overall weight of footwear 10. Furthermore, suitable materials may exhibit resistance to microbial growth and may have hydrophobic and oleophobic properties.

Core 50 may be affixed to base portion 41 or walls 42–45 through adhesive bonding or through a variety of mechanical fasteners. In addition, core 50 may be molded into support element 40. As depicted in the figures, core 50 has a generally planar configuration, but may also be molded to mimic the anatomical contours of the plantar foot area. Various contours may also be formed in core 50 to provide additional support in specific areas. For example, portions of core 50 positioned adjacent lateral side 15 may have a lesser thickness than portions adjacent medial side 14, thereby resisting pronation. Core 50 may also be formed of multiple materials in a layered configuration, or core 50 may have regions that are formed of different materials. For example, portions of core 50 positioned in heel region 13 may have a greater cushioning response than portions positioned in forefoot region 11. Core 50 may also be formed of two or more discrete elements, or core 50 may only extend through a portion of the cavity within support element 40.

Figure 6:
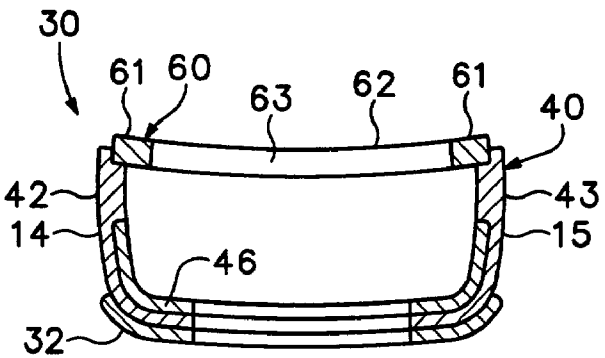
FIG. 6 is a second alternate cross-sectional view that corresponds with the cross-sectional view of FIG. 3A.
Figure 5:
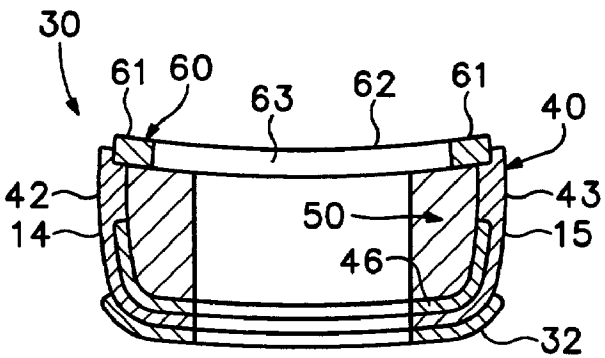
FIG. 5 is a first alternate cross-sectional view that corresponds with the cross-sectional view of FIG. 3A and depicts another embodiment of the present invention.

In an alternate embodiment, as depicted in FIG. 5, core 50 extends up to the lower surface of footbed 60, thereby eliminating displacement distance 16. When core 50 fills the entire cavity defined by support element 40 and footbed 60, the material selected for core 50 may have an increased compressibility to permit footbed 60 to deflect downward as if displacement distance 16 were present. Furthermore, sole structure 30 may be configured such that core 50 is attached to a lower surface of footbed 60, thereby permitting both core 50 and footbed 60 to deflect downward. Additionally, core 50 may be absent in some embodiments of the invention, as depicted in FIG. 6.

Footbed 60, which includes a perimeter portion 61 and a plurality of beams 62, is secured to walls 42–45 and is suspended above core 50. Perimeter portion 61 extends around footbed 60 and is generally secured to an upper portion of support element 40. For example, perimeter portion 61 may be secured to an upper surface of support element 40 or may be received within an indentation that circumscribes the interior surface of walls 42–45. Alternatively, perimeter portion 61 may have extensions that are secured to the exterior surface of support element 40. Beams 62 extend from medial areas of perimeter portion 61 to lateral areas of perimeter portion 61, thereby extending between medial side 14 to lateral side 15. Each beam 62 is separated from an adjacent beam 62 by a space 63. Accordingly, a plurality of spaces 63 are positioned between beams 62. This structure permits each beam 62 to deflect independently of other beams 62. For example, downward pressure on the beams 62 positioned in heel region 13 will cause a corresponding downward deflection only in heel region 13. As an alternative to the structure described above, each beam 62 may be molded directly into the sidewalls 42 and 43.

Each beam 62, which may resemble slats, is an elongate support member for the foot that extends from one side of sole structure 30 to an opposite side of sole structure 30. Beams 62 are depicted in the figures as extending from medial side 14 to lateral side 15, but may also extend from forefoot wall 44 to heel wall 45, for example. Beams 62 may also extend in a generally diagonal direction with respect to a longitudinal axis of sole structure 30. The various beams 62 are also depicted as being generally parallel with each other, but may also be obliquely arranged with respect to each other. Accordingly, beams 62 form elongate members that extend across the cavity within support element 40.

Beams 62 are supported on opposite ends, and the degree of deflection in beams 62 is dependent, therefore, upon the dimensions of each beam 62, the material forming each beam 62, and the force applied to each beam 62. With regard to the dimensions, each beam 62 may be characterized as including a length, a width, and a thickness. The length is represented in FIG. 2 as a dimension 64 and generally extends between opposing sides of perimeter portion 61. As noted above, beams 62 are supported on opposite ends, and the distance between the opposite ends forms the length. The width is represented in FIG. 2 as a dimension 65 and generally extends in a horizontal direction and between adjacent spaces 63. Similarly, the thickness is represented in FIG. 3A and generally extends between a bottom surface and a top surface of each beam 62.

As discussed above, the degree of deflection in beams 62 is at least partially dependent upon three factors: (1) the dimensions of each beam 62, (2) the material forming each beam 62, and (3) the force applied to each beam 62. The dimensions of each beam 62 may vary as the size of footwear 10 varies. Suitable dimensions for beams 62 positioned in heel region 13 are a length of 73 millimeters, a width of 6 millimeters, and a thickness of 2 millimeters. Beams 62 may be formed, for example, from a blend of polyether block amide and nylon 12 with 23% glass reinforcement. When formed of such a material and a force of approximately 112 Newtons is applied to beams 62, then the downward deflection of beams 62 may be approximately 8.5 millimeters. If the thickness is increased to 2.5 millimeters and other factors remain the same, then the downward deflection of beams 62 decreases to approximately 4.4 millimeters. As another example relating to footwear 10, beams 62 positioned in heel region 13 may have dimensions that include a length of 78.5 millimeters, a width of 6.8 millimeters, and a thickness of 2 millimeters. When these beams 62 are formed of the nylon and polyether block amide blend material discussed above, and a force of approximately 112 Newtons is applied to beams 62, then the downward deflection of beams 62 may be approximately 13.4 millimeters. If the thickness is increased to 2.9 millimeters and other factors remain the same, then the downward deflection of beams 62 decreases to approximately 4.4 millimeters.

The ratio of the width to thickness may vary significantly within the scope of the present invention and affects the overall deflection of beams 62. In the first example above, beams 62 had a width of 6 millimeters and a thickness that varied from 2 to 2.5 millimeters, and the corresponding deflection varied from 8.5 to 4.4 millimeters. By altering the ratio of width to thickness, therefore, significant changes in the deflection may result. As disclosed above, beams 62 have a rectangular cross-section, but may also have any other suitable cross-sectional shape. For example, beams 62 may have the configuration of an I-beam, a triangle, or a circle.

During walking or running, heel region 13 initially contacts the ground and experiences relatively high ground reaction forces. The forces experienced by beams 62 positioned in forefoot region 11 and midfoot region 12 will generally be relatively low in comparison. Accordingly, the dimensions of each beam 62 may be selected to account for the different forces experienced in different areas of sole structure 30. For example, the width and thickness of each beam 62 may be increased in areas of footbed 60 that experience the greatest forces, and the width and thickness of each beam 62 may be decreased in areas of footbed 60 that experience lesser forces. The dimensions of each beam 62 may also be selected to correspond with the weight and foot size of the individual. In general, the average weight of the individuals that may utilize footwear 10 increases as the size of footwear 10 increases. The length, width, and thickness of each beam 62 may, therefore, increase in a proportional manner as the size of footwear 10 increases. Depending upon the specific activity for which footwear 10 is utilized, forefoot region 11 or midfoot region 12 may also experience relatively high ground reaction forces. Accordingly, the dimensions of beams 62 in various areas of footwear 10 may be selected to account for the different activities that the individual may engage in.

Each beam 62 is depicted as having similar widths and thicknesses. That is, the width and thickness of one beam 62 is similar to the width and thickness of another beam 62. The length of each beam 62, however, varies throughout regions 11–13 to conform with the general shape of the foot in each of regions 11–13. Each beam 62 is also depicted as having a generally constant width and thickness. That is, the width and thickness of a particular beam 62 are constant as the particular beam 62 extends between medial side 14 and lateral side 15. In further embodiments of the invention, however, the widths and thicknesses of the various beams may vary. One rationale for varying the width and thicknesses of the beams 62 is to compensate for the different forces experienced by different beams 62, as discussed above. In general, an increase in one or both of the width and thickness may be utilized to increase the force-bearing capacity of the beams 62. Increases in the width and thickness may also be utilized to increase resistance to bending. Accordingly, the degree of deflection in each beam 62 may be decreased by increasing the dimensions of width and thickness.

The dimensions of the various beams 62 may be selected to impart a desired degree of deflection. If the dimensions are selected to permit a relatively small degree of deflection, then footwear 10 may have a hard, non-compliant feel. If, however, the dimensions are selected to permit a relatively large degree of deflection, then the footwear 10 may not exhibit the proper stability or impart the necessary degree of cushioning or support.

The number of beams 62 that may be incorporated into footbed 60 may vary significantly within the scope of the present invention. As depicted in FIGS. 2 and 4, footbed 60 is formed to have approximately twenty-seven beams 62. The standard measurement system for men's feet in the United States correlates a 10.5 inch length to a size 9.5. Assuming that footwear 10 is a size 9.5, then each beam 62 has an average width of approximately 0.4 inches. The number of beams 62 may be significantly less than the twenty-seven depicted in FIGS. 2 and 4 such that the average width is greater than approximately 0.4 inches. Similarly, the number of beams 62 may be significantly greater than the twenty-seven depicted in FIGS. 2 and 4 such that the average width is less than approximately 0.4 inches. In general, therefore, the number of beams 62 may range from approximately 8 to 75. In some embodiments, beams 62 may be located in a specific region of footbed 60, such as heel region 13, and three or more beams 62 may be utilized.

Footbed 60 may be formed from a diverse range of materials. Suitable materials for footbed 60 include polyester, thermoset urethane, thermoplastic urethane, various nylon formulations, blends of these materials, or blends that include glass fibers. In addition, footbed 60 may be formed from a high flex modulus polyether block amide, such as PEBAX, which is manufactured by the Atofina Company. Polyether block amide provides a variety of characteristics that benefit the present invention, including high impact resistance at low temperatures, few property variations in the temperature range of −40 degrees Celsius to positive 80 degrees Celsius, resistance to degradation by a variety of chemicals, and low hysteresis during alternative flexure. Another suitable material for footbed 60 is a blend of polyether block amide and nylon with 23% glass reinforcement. Furthermore, footbed 60 may be formed from a polybutylene terephthalate, such as HYTREL, which is manufactured by E.I. duPont de Nemours and Company. Composite materials may also be formed by incorporating glass fibers or carbon fibers into the polymer materials discussed above in order to enhance the strength of footbed 60. Metal materials, such as spring steel, may also be utilized to form footbed 60.

The various beams 62 are in neither tension nor compression when no downward forces are applied to footbed 60. That is, footbed 60 is in a non-stressed state when footwear 10 is not being worn by the individual. When a downward force is applied to footbed 60 (e.g., when the individual wears footwear 10) the various beams 62 deflect downward into the cavity. The deflection of an individual beam 62 induces both compression and tension in the individual beam 62. In other words, portions of the beam 62 located above a neutral axis are in compression, and portions of the beam 62 located below the neutral axis are in tension. Accordingly, beams 62 behave like a beam in bending when deflected.

Based upon the above discussion, footwear 10 has a structure wherein upper 20 forms a void for receiving the foot, and sole structure 30 forms a cavity. Footbed 60 is generally positioned between the void and the cavity, and footbed 60 is suspended above at least a portion of the cavity. This configuration permits footbed 60 to deflect downward into the cavity as forces are induced through walking or running. More specifically, the individual beams 62 of footbed 60 may independently deflect downward. As discussed above, this configuration may enhance the flexibility of footwear 10 and the distribution of plantar forces, thereby imparting comfort to footwear 10. Furthermore, this general configuration for sole structure 30 may isolate the foot from discontinuities on the ground.

As the individual walks or runs, the foot bends at the joints between the metatarsals and the phalanges, for example. In order to impart comfort, footwear 10 should also have a degree of flexibility in a corresponding location. The various beams 62 in footbed 60 provide flexion lines for sole structure 10, thereby promoting flexion along spaces 63. In some embodiments of the invention, some or all of beams 62 may be oriented obliquely with respect to the direction between the medial side 14 and the lateral side 15 such that flexion occurs in different directions. To further promote flexion in the area of footbed 60 corresponding with the joints between the proximal phalanges and the metatarsals, the structure of perimeter portion 61 in this area may be reduced.

A further benefit of the configuration of sole structure 30 relates to the distribution of plantar forces. In the conventional sole structure that includes a foam material for the midsole, a downward force that is applied in a specific location causes a downward deflection of the foam material at the specific location and in a significant area that surrounds the specific location. That is, a localized downward force also causes portions of the polymer foam material that are not immediately under the localized downward force to deflect. In sole structure 30, however, a downward force that is concentrated on a single beam 62 will generally deflect only that beam 62. Accordingly, the deflection that is caused by a downward force may be limited to the area of one of the beams 62.

Discontinuities on the ground (e.g., a rock, twig, projection, depression, etc.) are often perceptible by an individual that is wearing an article of footwear with the conventional sole structure. That is, when the individual steps on a discontinuity, the conventional sole structure deflects in a manner that is perceptible by the individual. The configuration of sole structure 30, however, isolates the effect of discontinuities such that the discontinuities may not be perceptible by the individual. When the individual steps on a rock or other projection, for example, outsole 32, base portion 41, and core 50 may deflect upward. In order for the individual to perceive the discontinuity, core 50 must deflect across displacement distance 16 and contact the lower surface of foot bed 60. For an average discontinuity, the degree of upward deflection will not extend entirely across displacement distance 16 and the individual will not, therefore, generally perceive the discontinuity. As a design consideration, the height of displacement distance 16 may be selected based upon the intended activity for footwear 10 and the foreseeable discontinuities that are commonly encountered during the activity.

Another advantage of sole structure 30 relates to the concept of ventilation. Referring to FIG. 4, a plurality of apertures 33 are formed in outsole 32, a plurality of apertures 48 are formed in support element 40, and a plurality of apertures 51 are formed in core 50. Apertures 33, 48, and 51 are generally formed in an aligned manner such that air may pass into and out of sole structure 30. As footbed 60 deflects downward, the volume of the cavity within support element 40 decreases. This provides a compressive force that moves air out of sole structure 30 through the various apertures 33, 48, and 51. Similarly, as force is removed from footbed 60 and the degree of deflection lessens, the volume of the cavity within support element 40 will increase, thereby drawing air into sole structure 30. A portion of the air that passes in or out of sole structure 30 may also be from the void within upper 20. As the individual exercises, perspiration may collect within the void. The movement of air through footwear 10 will assist in removing the perspiration and cooling the foot.

Figure 7:
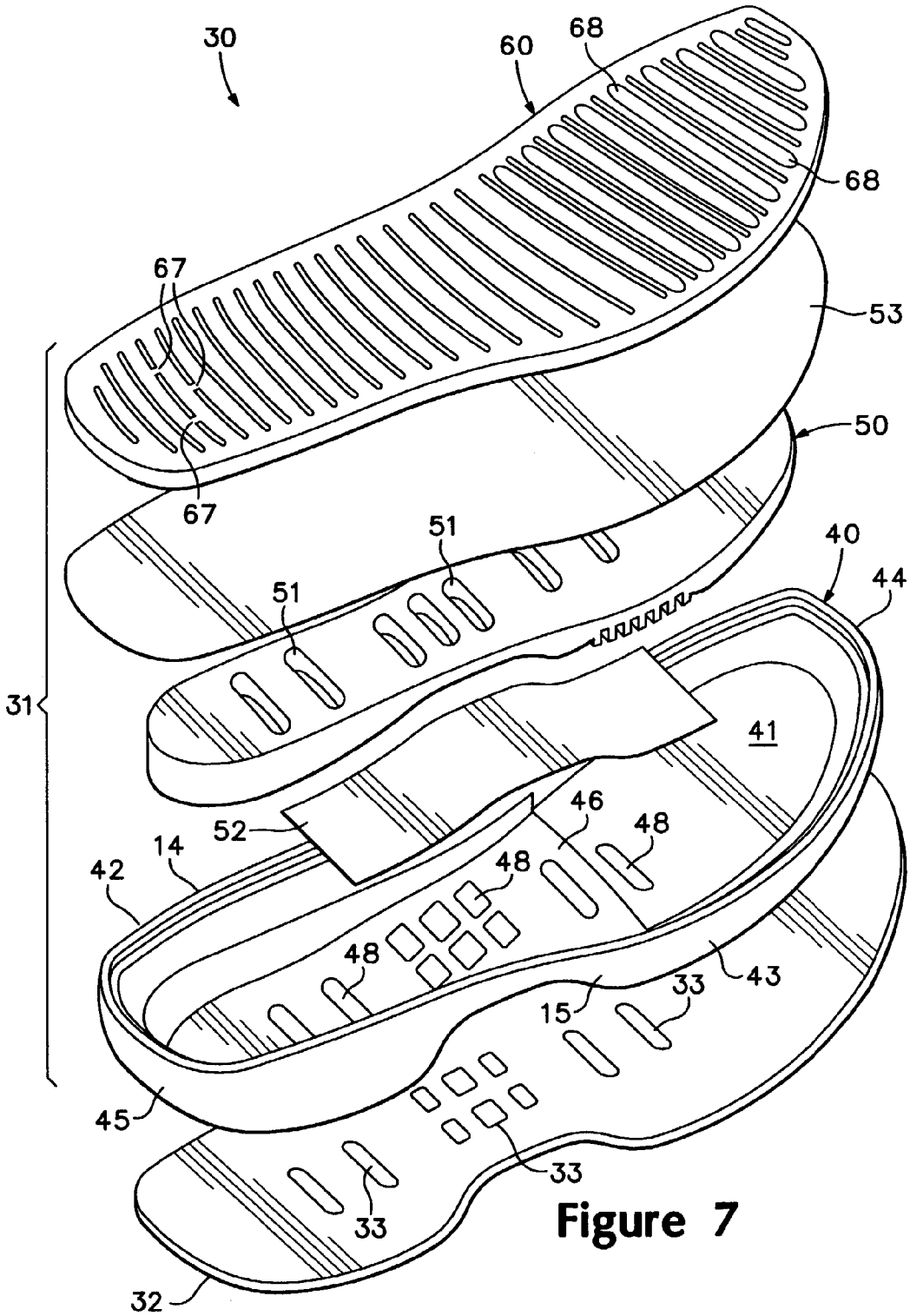
FIG. 7 is an alternate exploded perspective view of the sole structure.

Filter materials may be incorporated into sole structure 30 to limit the quantity and size of particulates that enter the cavity within sole structure 30. Referring to FIG. 7, a first filter 52 is depicted as being positioned between core 50 and base portion 41. In addition, a second filter 53 is depicted as being positioned between core 50 and footbed 60. A filter material may also be located between outsole 32 and base portion 41, for example. Filters 52 and 53 may be formed from a variety of materials, such as high density polyethylene, ultrahigh molecular weight polyethylene, polyvinylidene fluoride, and polypropylene, for example. Knit materials, woven materials, nonwoven materials, and laminate structures consisting of one or more differing filter materials may also be suitable. Additional suitable materials for filter 52 and 53 are polytetrafluoroethylene (PTFE) and expanded polytetrafluoroethylene (ePTFE), which provides sufficient filtration and is suitably durable when attached to a substrate such as non-woven polyester. The PTFE and ePTFE filter materials also have the advantage of limiting the entry of water or other liquids. As an alternative to the use of filters 52 and 53, the various apertures 33, 48, and 51 may be made to have a size that permits particulates to freely pass into and out of sole structure 30. The filter materials that are incorporated into sole structure 30 may also be selected to permit the passage of water or other liquids. For example, footwear 10 may be designed specifically for aquatic activities, wherein advantages may be gained by permitting water to pass freely through sole structure 30.

In the configuration of footbed 60 discussed above, the individual beams 62 may independently deflect downward into the cavity as forces are induced through walking or running, for example. In some embodiments of the invention, selected beams 62 may be joined together to limit the independent deflection in specific areas. Referring to FIG. 7, three links 67 are depicted as joining beams 62 in heel region 13 of footbed 60. Each link 67 extends between two adjacent beams 62 and across the space 63 between the two adjacent beams 67. If a downward force is applied to one of the selected beams 62, then the other beam 62 will also deflect downward in response. Depending upon the structure of each link 67, the degree of downward deflection in the other beams 62 may not be as great as the deflection of the specific beam 62 to which the downward force is applied.

The upper surface of footbed 60 may have a generally planar configuration, or may be either concave or convex. In one embodiment of the invention, the upper surface includes various upward projections and downward depressions that mimic the anatomical contours of the foot. For example, the heel region 13 may include a depression for receiving the heel of the foot, and the midfoot region 12 may include an projection adjacent medial side 14 to form an arch support.

The upper surface of footbed 60 may exhibit a variety of configurations that limit movement of the foot or enhance the comfort of footwear 10. Footbed 60 may be made from a plurality of polymer materials, as discussed above, and the upper surface of footbed 60 may, therefore, exhibit a smooth texture that permits the foot to slide relative to footbed 60. In order to counter sliding of the foot, the upper surface of footbed 60 may be textured. Alternately a contact layer 68 may be added to the upper surface of footbed 60, as depicted in FIG. 7. In general, contact layer 68 is an additional element of material that extends between the upper surface of footbed 60 and the foot. As depicted in FIG. 7, contact layer 68 includes a plurality of material strips that extend over selected spaces 63. Alternately, contact layer 60 may extend over the entire upper surface of footbed 60, or may extend over only a portion of the upper surface of footbed 60. In addition, contact layer 68 may be located only on specific beams 62.

Contact layer 68 may be formed from a variety of textile materials, including woven and non-woven textiles. In addition, contact layer 68 may be a polymer-based material, such as a relatively soft thermoplastic or thermoset urethane having a hardness of approximately 40–70 on the Shore A scale. Various injectable materials may also be utilized. Contact layer 68 may serve a variety of purposes. For example, contact layer 68 may be formed from a compressible material that improves the comfort of footbed 60. Contact layer 68 may also impart non-slip properties, or contact layer 68 may be a strobel sock or insole that is above footbed 60. Depending upon the distance between adjacent beams 62, contact layer 68 may prevent portions of the foot from being pinched between beams 62 as a result of flexion in footbed 60. As spaces 63 are separated further, however, pinching of the foot becomes a consideration and the contact layer 68 may be utilized. Contact layer 68 may be molded integrally (co-molded) with footbed 60, or may be applied following the formation of footbed 60 with adhesives. Contact layer 68 may also be applied through welding, spraying, or dipping, for example. In general, the configuration of contact layer 68 may also be selected to not hinder the independent deflection of the various beams 62.

Figure 8:
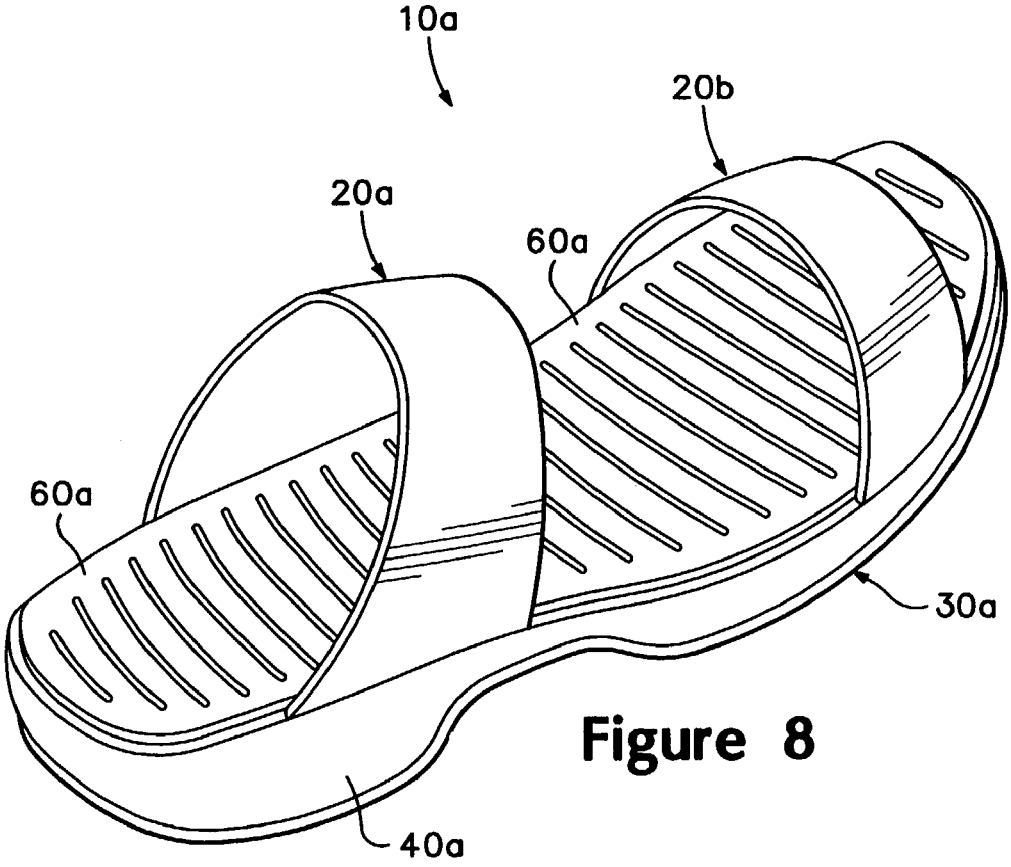
FIG. 8 is a perspective view of another article of footwear incorporating the sole structure.

Footwear 10 is discussed above as having the configuration of an athletic article of footwear, such as a walking shoe. Referring to FIG. 8, an article of footwear 10*a* is depicted that has a sole structure 30*a* with the general structure of sole structure 30. In contrast with footwear 10, however, footwear 10*a* includes an upper 20*a* having the configuration of a sandal upper. Upper 20*a* includes a pair of straps that define a void for receiving the foot and secure footwear 10*a* to the foot. The straps may extend between footbed 60*a* and support element 40*a*, and indentations may be formed in either footbed 60*a* or support element 40*a* to accommodate the straps. Accordingly, the concepts of the present invention may be applied to a variety of footwear types, in addition to athletic footwear.

Figure 9:
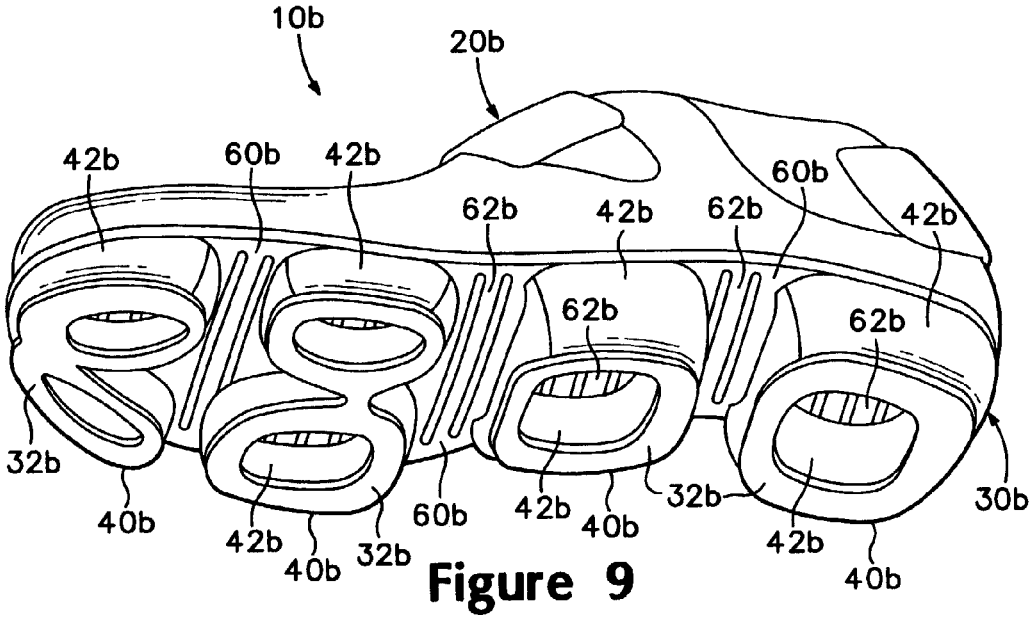
FIG. 9 is a perspective view of yet another article of footwear incorporating a sole structure in accordance with the present invention.
Figure 10:
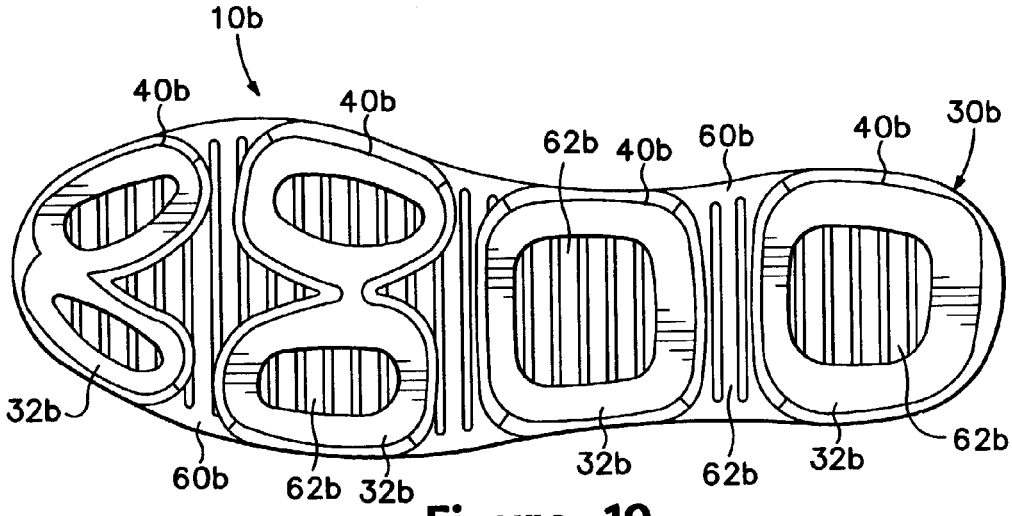
FIG. 10 is a bottom plan view of the footwear depicted in FIG. 9.

Referring to FIGS. 9 and 10, an article of footwear 10*b* is depicted that includes an upper 20*b* and a sole structure 30*b*. Upper 20*b* has a generally conventional configuration, and sole structure 30*b* is secured to upper 20*b*. Sole structure 30*b* includes a footbed 60*b* that has the general configuration of footbed 60, as discussed above. Sole structure 30*b* also includes a plurality of sole pods 40*b* that have sidewalls 42*b* and outsole sections 32*b*. Sole pods 40*b* have a generally circular or square configuration that each define cavities. Sidewalls 42*b* may be formed of a polymer foam material, such as polyurethane or ethylvinylacetate, and outsole sections 32*b* may be formed of a rubber material that provides wear-resistance and durability. The sole pods 40*b* positioned in a forefoot region of footwear 10*b* are connected to an adjacent sole pod 40*b,* whereas the sole pods positioned in a midfoot region and a heel region of footwear 10*b* are independent and unconnected to other sole pods 40*b*. As a variation upon the configuration of sole structure 30*b,* a pod 40*b* may extend around the entire perimeter of footwear 10*b*. Accordingly, an article of footwear may be formed that includes a single pod 40*b* that defines a single cavity to accommodate the deflection of footbed 60.

Selected sole pods 40*b* may be secured to perimeter areas of footbed 60*b* and may bow downward in central areas in order to permit downward deflection. That is, the upper surface of sole pods 40*b* may be non-planar to facilitate downward deflection of footbed 60*b*. In addition, portions of pods 40*b* facing outward from footwear 10*b* may be formed of a less-compressible material than interior portions. Accordingly, pods 40*b* may be formed of a dual-density foam, for example.

The configuration of sole structure 30*b* described above has enhanced flexibility due to the configuration of the sole pods 40*b*. That is, sole structure 30*b* may flex in the areas between sole pods 40*b* by merely bending footbed 60*b*. In addition, various beams 62*b* of footbed 60*b* may independently deflect into the cavities within the sole pods 40*b* in order provide the advantages discussed above, which includes a high degree of ventilation and weight savings.

Figure 11:
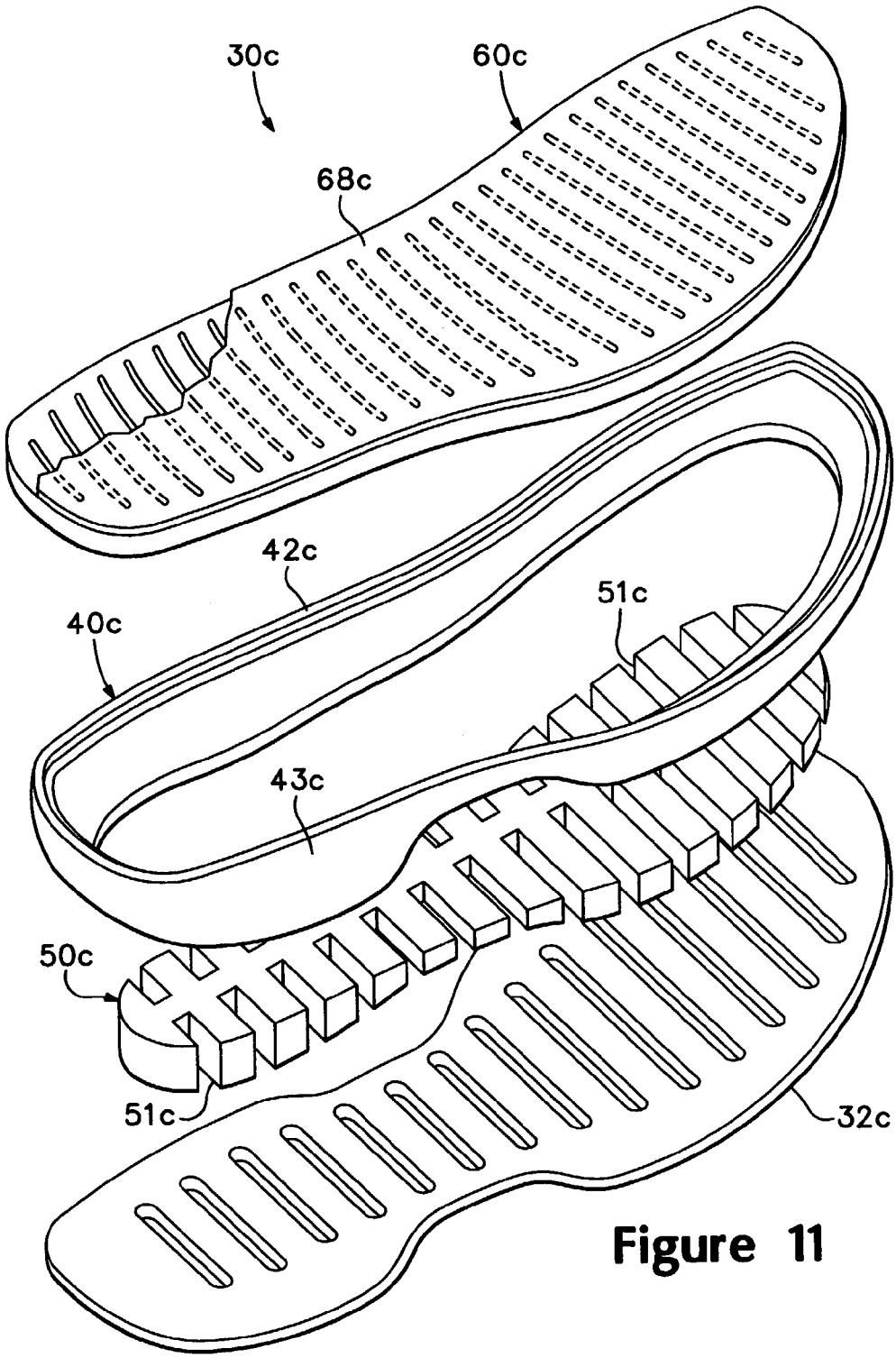
FIG. 11 is an exploded perspective view of another article of footwear incorporating a sole structure in accordance with the present invention.

Another sole structure 30*c* is depicted in FIG. 11 and includes the general components described above with respect to sole structure 30. Accordingly, sole structure 30*c* includes an outsole 32*c,* a support element 40*c,* a core 50*c,* and a footbed 60*c*. In contrast with sole structure 30, support element 40*c* does not include a base portion 41. Instead, support element 40*c* includes sidewalls 42*c* and 43*c* and a lower opening in place of base portion 41. Outsole 32*c* is secured to lower areas of support element 40*c* and extends across the opening. Core 50*c* is secured to outsole 32*c* and is within the cavity defined by outsole 32*c* and sidewalls 42*c* and 43*c*. A further characteristic of sole structure 30*c* relates to the configuration of core 50*c*. Rather than forming apertures in central areas, various apertures 51*c* are formed in the edges of core 50*c* to correspond with apertures in outsole 32*c*. Furthermore, a contact layer 68*c* extends over the entire surface of footbed 60*c*. Contact layer 68*c* may be formed from a variety of textile materials, including woven and non-woven textiles. In addition, contact layer 68*c* may be a polymer-based material, such as a relatively soft thermoplastic or thermoset urethane having a hardness of approximately 40–70 on the Shore A scale. Various injectable materials may also be utilized. Contact layer 68*c* may be molded integrally (co-molded) with footbed 60, or may be applied following the formation of footbed 60 with adhesives. Contact layer 68*c* may also be applied through welding, spraying, or dipping, for example.

Contact layer 68*c* is depicted in FIG. 11 as extending uniformly over the entire surface of footbed 60*c*. In further embodiments of the invention, contact layer 68*c* may have a plurality of spaces that correspond with spaces 63, and various links may extend across the spaces. Contact layer 68*c* may also have various apertures or a contoured configuration. Furthermore, contact layer 68*c* may have regions that are formed of different materials. For example, a cloth material may be utilized in midfoot region 12 and heel region 13, whereas a thermoplastic urethane may be utilized in forefoot region 11. Accordingly, the specific configuration and materials utilized for contact layer 68*c* may vary significantly within the scope of the invention.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of footwear comprising:

an upper that defines a void for receiving a foot; and a sole structure secured to the upper and defining at least one cavity, the sole structure having a footbed suspended between at least a portion of the cavity and the void to provide support for the foot, the footbed including a plurality of beams that have a semi-rigid structure and extend across the cavity, a majority of the beams having substantially equal widths and spacing, at least a portion of the beams being independently deflectable into the cavity.

2. The article of footwear recited in claim 1, wherein at least a portion of the beams extend from a medial side of the footwear to a lateral side of the footwear.

3. The article of footwear recited in claim 1, wherein spaces are formed between at least a portion of the beams.

4. The article of footwear recited in claim 1, wherein the footbed includes a perimeter portion that extends around the footbed and forms a perimeter of the footbed, and the beams extend between opposite sides of the perimeter portion.

5. The article of footwear recited in claim 1, wherein at least a portion of the beams are oriented parallel to each other.

6. The article of footwear recited in claim 1, wherein the footbed includes at least eight beams.

7. The article of footwear recited in claim 1, wherein the cavity and the footbed extend from a forefoot portion of the sole structure to a heel portion of the sole structure.

8. The article of footwear recited in claim 1, wherein the cavity is formed by a support element having sidewalls.

9. The article of footwear recited in claim 8, wherein the footbed is secured to an upper surface of the support element.

10. The article of footwear recited in claim 8, wherein a plate is positioned within the cavity and adjacent to a base portion of the cavity.

11. The article of footwear recited in claim 10, wherein a portion of the plate extends upward and along the sidewalls.

12. The article of footwear recited in claim 1, wherein a core is located within the cavity, the core being formed from a compressible material.

13. The article of footwear recited in claim 12, wherein the core extends from a medial side of the cavity to a lateral side of the cavity.

14. The article of footwear recited in claim 12, wherein the core is spaced from the footbed.

15. The article of footwear recited in claim 12, wherein the core is formed of a polymer foam material.

16. The article of footwear recited in claim 12, wherein at least one aperture extends through the core to permit air to pass into the cavity.

17. The article of footwear recited in claim 16, wherein a filter material is positioned adjacent the core.

18. The article of footwear recited in claim 16, wherein a filter material is positioned between the core and the footbed.

19. The article of footwear recited in claim 1, wherein at least two adjacent beams are joined together with a link that extends across a space between the at least two adjacent beams.

20. The article of footwear recited in claim 1, wherein a contact layer extends over at least a portion of an upper surface of the footbed.

21. The article of footwear recited in claim 1, wherein at least a portion of the beams are supported on opposite sides.

22. The article of footwear recited in claim 1, wherein the sole structure includes at least two sole pods, each sole pod having sidewalls that extend downward from the footbed to define at least two of the cavity.

23. An article of footwear having an upper and a sole structure secured to the upper, the sole structure comprising:

a support element with sidewalls that define a cavity within the support element;

a footbed secured to the sidewalls and suspended above at least a portion of the cavity, the footbed having a forefoot region, a midfoot region, and a heel region, and the footbed including a plurality of beams that extend across the cavity and are supported on opposite ends, the beams being separated by spaces in the footbed, and the beams being oriented parallel to each other, at least a portion of the beams being independently deflectable into the cavity, at least a portion of the beams being dimensioned to have a width that is greater than a thickness, and at least one of the beams being positioned in each of the forefoot region, the midfoot region, and the heel region; and a core positioned within the cavity and below the footbed, the core being formed of a compressible material.

24. The article of footwear recited in claim 23, wherein the beams extend from a medial side of the footwear to a lateral side of the footwear.

25. The article of footwear recited in claim 23, wherein the footbed includes a perimeter portion that extends around the footbed and forms a perimeter of the footbed, and the beams extend between opposite sides of the perimeter portion.

26. The article of footwear recited in claim 25, wherein the footbed is secured to an upper portion of the support element.

27. The article of footwear recited in claim 23, wherein the footbed includes at least three of the beams.

28. The article of footwear recited in claim 23, wherein the cavity and the footbed extend from a forefoot portion of the sole structure to a heel portion of the sole structure.

29. The article of footwear recited in claim 23, wherein a plate is positioned within the cavity and adjacent to a base portion of the support element.

30. The article of footwear recited in claim 29, wherein a portion of the plate extends upward and along the sidewalls.

31. The article of footwear recited in claim 23, wherein a top surface of the core is spaced from a lower surface of the footbed.

32. The article of footwear recited in claim 23, wherein the core extends from a medial side of the cavity to a lateral side of the cavity.

33. The article of footwear recited in claim 23, wherein the core contacts a lower surface of the footbed.

34. The article of footwear recited in claim 23, wherein the core is formed of a polymer foam material.

35. The article of footwear recited in claim 23, wherein a filter material is positioned within the cavity.

36. The article of footwear recited in claim 23, wherein a filter material is positioned between the core and the footbed.

37. The article of footwear recited in claim 23, wherein at least two adjacent beams are joined together with a link that extends across the space between the at least two adjacent beams.

38. The article of footwear recited in claim 29, wherein a contact layer extends over at least a portion of an upper surface of the footbed.

39. The article of footwear recited in claim 38, wherein the contact layer extends over at least a portion of the spaces.

40. An article of footwear having an upper and a sole structure secured to the upper, the sole structure comprising:

at least one sole element that defines a cavity; and a foot-supporting member formed from a semi-rigid polymer material and suspended over the cavity, the foot-supporting member including a plurality of spaces that extend through the foot-supporting member and define at least eight beams supported on opposite ends and having lengths extending in a direction between a lateral side of the footwear and a medial side of the footwear, at least a portion of the beams being independently deflectable into the cavity, wherein the beams include a first beam located in a forefoot region of the foot-supporting member, a second beam located in a midfoot region of the foot-supporting member, and a third beam located in a heel region of the foot-supporting member, each of the first beam, the second beam, and the third beam having different lengths.

41. The article of footwear recited in claim 40, further including a core that is located within the cavity, the core being formed from a compressible material.

42. The article of footwear recited in claim 41, wherein the core is spaced from the foot-supporting member.

43. The article of footwear recited in claim 40, further including an outsole secured to the sole element.

44. The article of footwear recited in claim 43, wherein the sole element defines at least one aperture to permit air to pass into the cavity.

45. The article of footwear recited in claim 44, further including a filter material positioned adjacent the aperture.

46. The article of footwear recited in claim 40, wherein at least two adjacent beams are joined together with a link that extends across the space between the at least two adjacent beams.

47. The article of footwear recited in claim 40, wherein at least a portion of the beams are dimensioned to have a width that is greater than a thickness.

48. The article of footwear recited in claim 40, wherein the at least one sole element is at least two sole pods, each sole pod having sidewalls that extend downward from the footbed to define at least two of the cavity.

49. An article of footwear comprising:

an upper that defines a void for receiving a foot; and a sole structure secured to the upper, the sole structure defining a cavity, the sole structure also having a foot-supporting member suspended between at least a portion of the cavity and the void to provide support for the foot, the foot-supporting member including a plurality of beams that extend across the cavity and are formed from a semi-rigid polymer material, at least a portion of the beams being supported on opposite ends and independently deflectable into the cavity, the beams being evenly distributed from a forefoot region of the footwear to a heel region of the footwear.

50. The article of footwear recited in claim 49, further including a core is located within the cavity, the core being formed from a compressible material.

51. The article of footwear recited in claim 50, wherein the core is spaced from the foot-supporting member.

52. The article of footwear recited in claim 49, further including a rubber outsole secured to the polymer foam material.

53. The article of footwear recited in claim 49, wherein at least a portion of the beams are dimensioned to have a width that is greater than a thickness.

54. The article of footwear recited in claim 49, wherein the midsole is at least two sole pods, each sole having sidewalls that extend downward from the foot-supporting member to define at least two of the cavity.

55. An article of footwear having an upper and a sole structure secured to the upper, the sole structure comprising:

at least one sole element that defines a cavity; and a foot-supporting member formed from a semi-rigid polymer material and suspended over the cavity, the foot-supporting member including a plurality of spaces that extend through the foot-supporting member to define a plurality of beams, the spaces being evenly distributed from a forefoot region of the foot-supporting member to a heel region of the foot-supporting member, the beams being supported on opposite ends and extending from a medial side to a lateral side of the foot supporting member.

56. The article of footwear recited in claim 55, wherein the beams are evenly distributed from the forefoot region to the heel region.

57. The article of footwear recited in claim 55, further including an outsole secured to the sole element.

58. The article of footwear recited in claim 55, wherein the sole element deines at least one aperture that extends through a lower surface of the sole element.

59. The article of footwear recited in claim 58, wherein the foot-supporting member is exposed through the aperture.

60. The article of fbotwear recited in claim 55, wherein, at least a portion of the beams are dimensioned to have a width that is greater than a thickness.

61. The article of footwear recited in claim 55, further including a core that is located within the cavity, the core being formed from a compressible material.

62. The article of footwear recited in claim 61, wherein the core is spaced from the foot-supporting member.

* * * * *